US008851729B2

(12) United States Patent
Tsukamoto

(10) Patent No.: US 8,851,729 B2
(45) Date of Patent: Oct. 7, 2014

(54) VEHICULAR LAMP

(71) Applicant: Hironori Tsukamoto, Shizuoka (JP)

(72) Inventor: Hironori Tsukamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/828,193

(22) Filed: Mar. 14, 2013

(65) Prior Publication Data

US 2013/0250602 A1 Sep. 26, 2013

(30) Foreign Application Priority Data

Mar. 22, 2012 (JP) ..... 2012-065093

(51) Int. Cl.
*F21S 8/10* (2006.01)

(52) U.S. Cl.
CPC ..... *F21S 48/00* (2013.01); *F21S 48/321* (2013.01); *F21S 48/1159* (2013.01); *F21S 48/1109* (2013.01)
USPC ..... 362/545; 362/547; 362/249.02

(58) Field of Classification Search
CPC ..... F21S 48/00; F21S 48/1109
USPC ..... 362/545, 547, 249.02
See application file for complete search history.

(56) References Cited

U.S. PATENT DOCUMENTS 7,665,872 B2 * 2/2010 Nakabayashi ..... 362/545

FOREIGN PATENT DOCUMENTS

JP 2010-073620 A 4/2010

* cited by examiner

*Primary Examiner* — Anabel Ton
(74) *Attorney, Agent, or Firm* — Sughrue Mion, PLLC

(57) ABSTRACT

A vehicular lamp includes: a light source that emits light; a lamp body, inside of which the light source is arranged; a circuit board that has a conductive pattern that functions as an electrically-conducting path of drive current to be supplied to the light source, and on one end portion of which an electrode portion connected to the conductive pattern is formed; a socket connected to the lamp body; and a contact member that is arranged in the socket and has an elastically deformable connecting terminal portion connected to the electrode portion of the circuit board, and a plug connecting portion, to which a power supply plug is connected, wherein the circuit board is pressed by restoring force of the connecting terminal portion, elastically deformed, so as to be held by the contact member.

9 Claims, 6 Drawing Sheets

VEHICULAR LAMP

INCORPORATION BY REFERENCE

The disclosure of Japanese Patent Application No. 2012-065093 filed on Mar. 22, 2012 including the specification, drawings and abstract is incorporated herein by reference in its entirety.

BACKGROUND OF THE INVENTION

1. Field of the Invention

The invention relates to a vehicular lamp. More particularly, the invention relates to a technical field for improving workability related to the assembly of a circuit board provided in a vehicular lamp.

2. Description of Related Art

Japanese Patent Application Publication No. 2010-73620 (JP 2010-73620 A), for example, describes a vehicular lamp, in which a light source is arranged inside a lamp outer casing formed of a cover and a lamp body, and a drive current is supplied to the light source from a power supply circuit via a circuit board having a conductive pattern that functions as an electrically-conducting path of the drive current.

In the vehicular lamp described in JP 2010-73620 A, the circuit board on which the light source is mounted is arranged inside the lamp outer casing, and a harness that is connected to the circuit board is pulled out from the lamp body and connected to the power supply circuit.

However, with the vehicular lamp described in JP 2010-73620 A, the structure is such that the drive current is supplied to the light source via the circuit board by the harness and therefore, it is necessary to perform both work to connect the harness to the circuit board by soldering, and work to pull the harness around inside and outside of the lamp body.

Therefore, the work related to the circuit board is troublesome and therefore, there is room for improvement to improve workability related to the assembly and the like of the circuit board.

SUMMARY OF THE INVENTION

The invention provides a vehicular lamp, with which it is possible to improve workability related to the assembly and the like of a circuit board provided in the vehicular lamp.

A vehicular lamp according to an aspect of the invention includes a light source that emits light; a lamp body inside of which the light source is arranged; a circuit board that has a conductive pattern that functions as an electrically-conducting path of drive current to be supplied to the light source, and on one end portion of which an electrode portion connected to the conductive pattern is formed; a socket connected to the lamp body; and a contact member that is arranged in the socket and has an elastically deformable connecting terminal portion connected to the electrode portion of the circuit board, and a plug connecting portion, to which a power supply plug is connected. The circuit board is pressed by restoring force of the connecting terminal portion, elastically deformed, so as to be held by the contact member.

Accordingly, in this vehicular lamp, the circuit board is held by the elastic connecting terminal portion that is connected to the electrode portion.

Therefore, a harness for supplying drive current to the light source is not necessary, so that neither the work of connecting a harness to the circuit board by soldering nor the work of pulling the harness around inside and outside of the lamp body is needed. Hence, workability related to the assembly of the circuit board and the like is improved.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of a vehicular lamp of the invention will hereinafter be described with reference to the accompanying drawings.

In the description below, the directions of front, rear, up, down, left, and right, are referred to with the direction in which the light source is directed, i.e., the direction in which light from the light source is emitted, being forward (i.e., the front).

The directions of front, rear, up, down, left, and right are used merely to facilitate the description. Embodiments of the invention are not limited by these directions.

Figure 1:
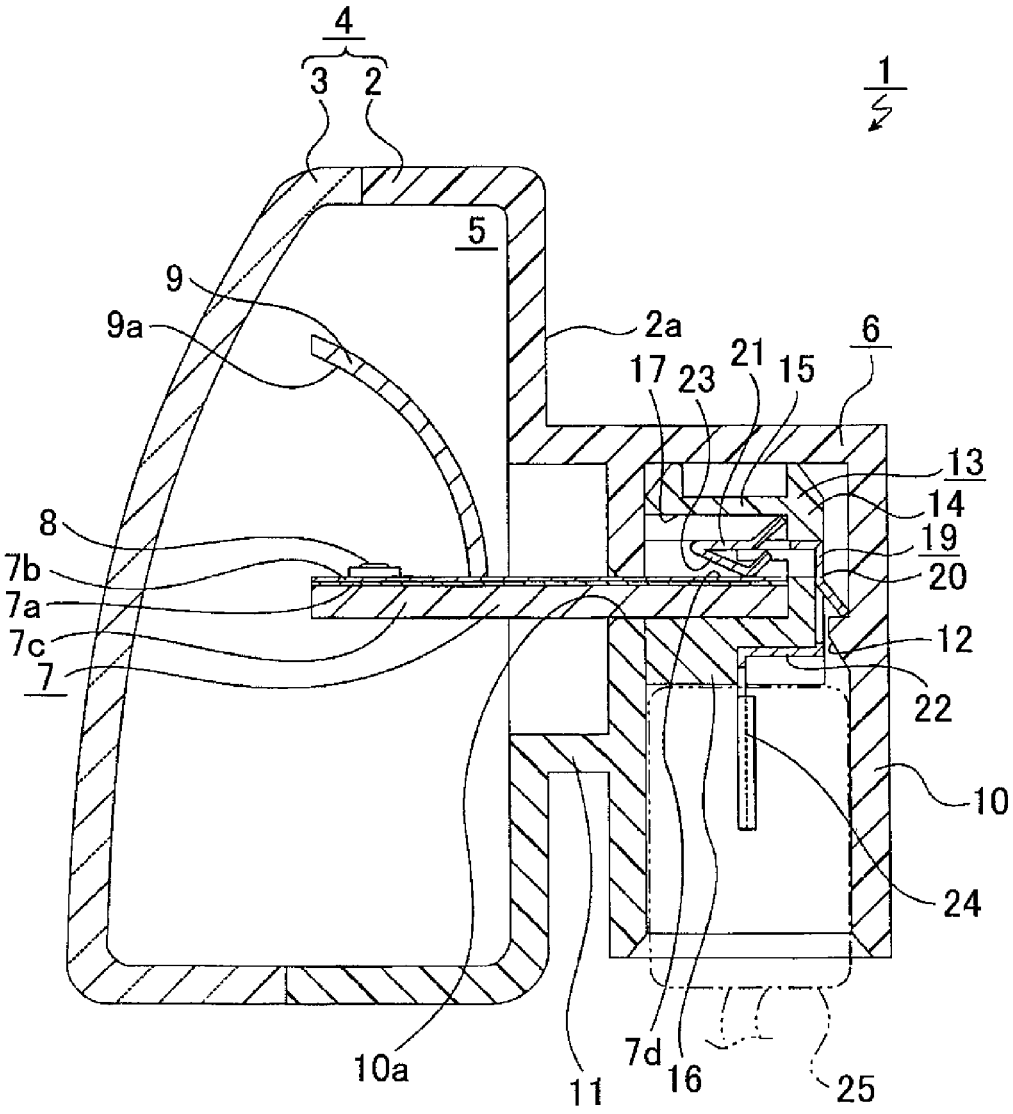
FIG. 1 is a sectional view schematically showing a vehicular lamp according to one embodiment of the invention.

As shown in FIG. 1, a vehicular lamp 1 includes a lamp body 2 that has a recessed portion that is open to the front, and a cover 3 that covers the opening of the lamp body 2. A lamp outer casing 4 is formed of the lamp body 2 and the cover 3. A space inside the lamp outer casing 4 is formed as a lamp chamber 5.

A socket 6 that protrudes to the rear is connected to a rear surface portion 2*a* of the lamp body 2. The socket 6 may be formed using a member separate from the lamp body 2. Alternatively, the socket 6 may be formed integrally with the lamp body 2. Forming the socket 6 integrally with the lamp body 2 reduces the manufacturing cost, owing to the decrease in the number of parts.

A circuit board 7 is arranged in a position extending from the lamp chamber 5 into the socket 6. A portion of the circuit board 7, excluding a rear end portion thereof, is attached to an attaching member, not shown, that is arranged in the lamp chamber 5. Any of various types of rigid circuit boards such as a glass epoxy circuit board, or flexible circuit boards that are able to bend, or the like, may be used as the circuit board 7.

The circuit board 7 has an isolation portion 7*a*, a conductive pattern 7*b* formed on an upper surface of the isolation portion 7*a*, and a heat radiating portion 7*c* made of metal material laminated to a lower surface side of the isolation portion 7*a*. Electrode portions 7*d* that are connected to the conductive pattern 7*b* are formed spaced apart to the left and right on the rear end portion of the circuit board 7. The heat radiating portion 7*c* may be made of resin material having high thermal conductivity.

A light source 8 is mounted in a position on the front end side on the upper surface of the circuit board 7. A light emitting diode (LED), for example, is used as the light source 8. A drive current is supplied to the light source 8 from a power supply circuit, not shown, via the circuit board 7, and light is emitted from the light source 8 according to the supplied drive current. At this time, the circuit board 7 generates heat, but the generated heat is released from the heat radiating portion 7*c*, so that an increase in the temperature of the circuit board 7 and the light source 8 is suppressed.

A reflector 9 is arranged in the lamp chamber 5. This reflector 9 is formed as a reflective surface 9*a*.

Light emitted from the light source 8 is reflected by the reflective surface 9*a* of the reflector 9, passes through the cover 3, and is illuminated forward.

Figure 2:
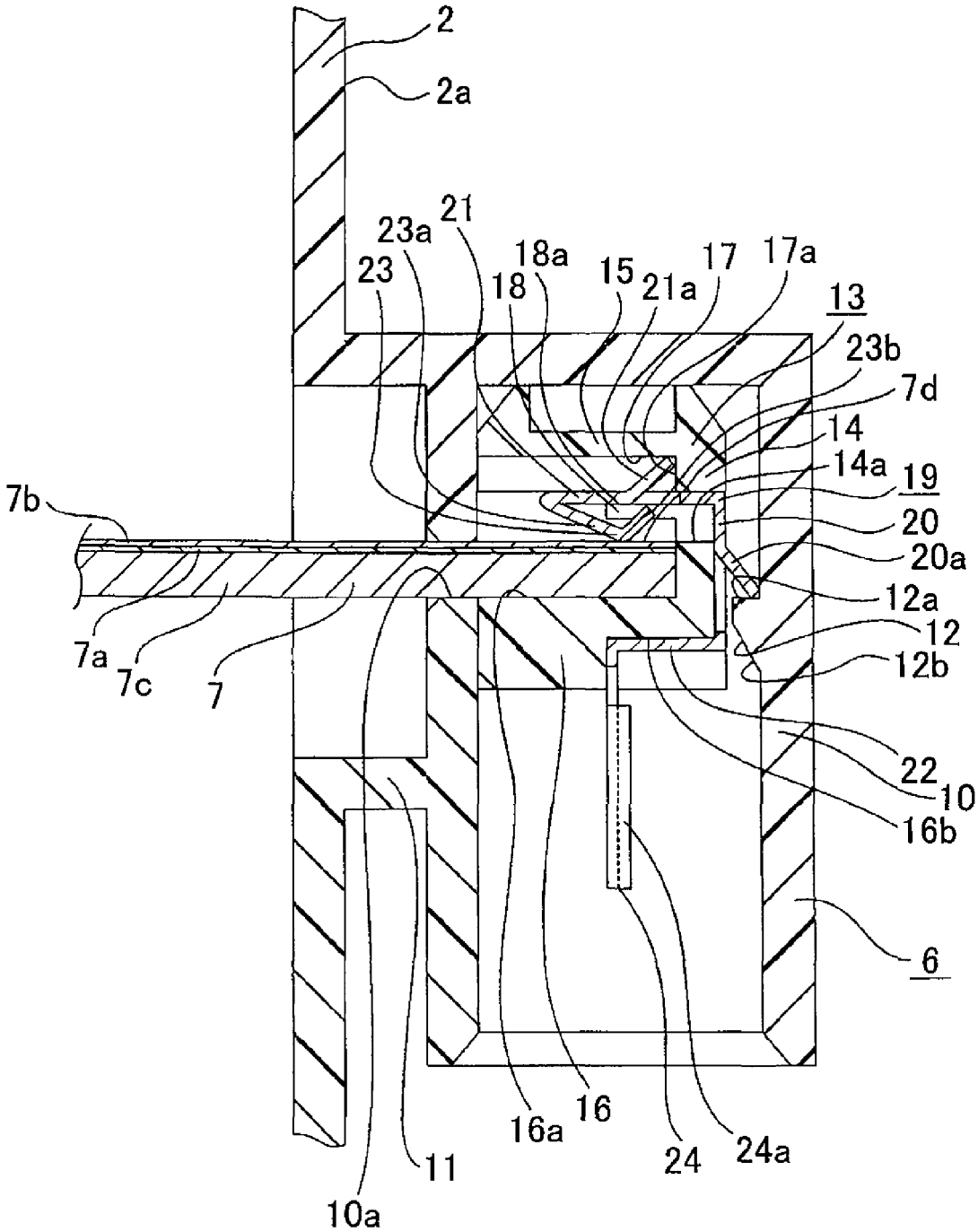
FIG. 2 is an enlarged sectional view showing a state in which a contact holder and contact members are inserted in a socket according to the embodiment.
Figure 3:
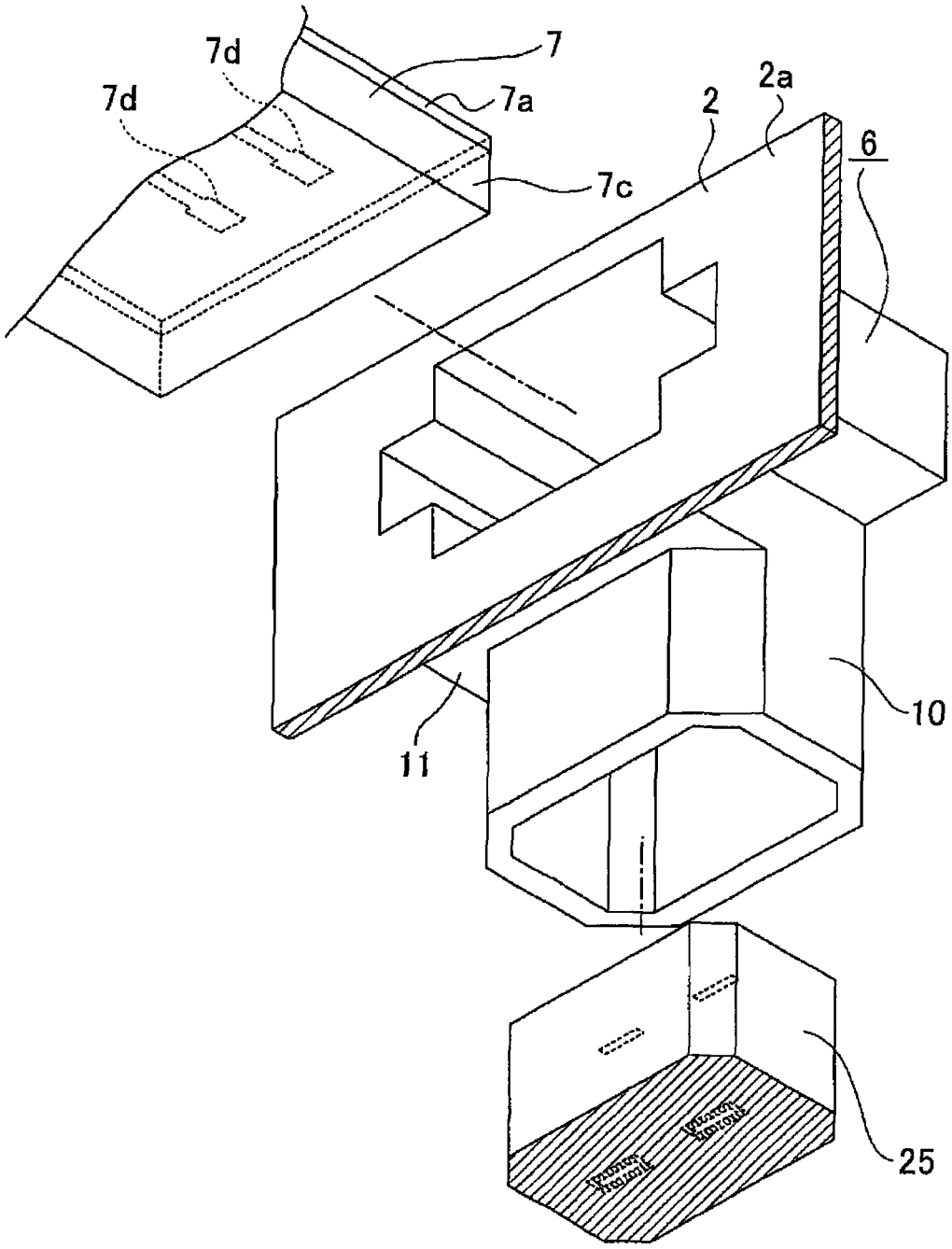
FIG. 3 is an enlarged exploded perspective view of the socket, a circuit board, and a plug according to the embodiment.
Figure 4:
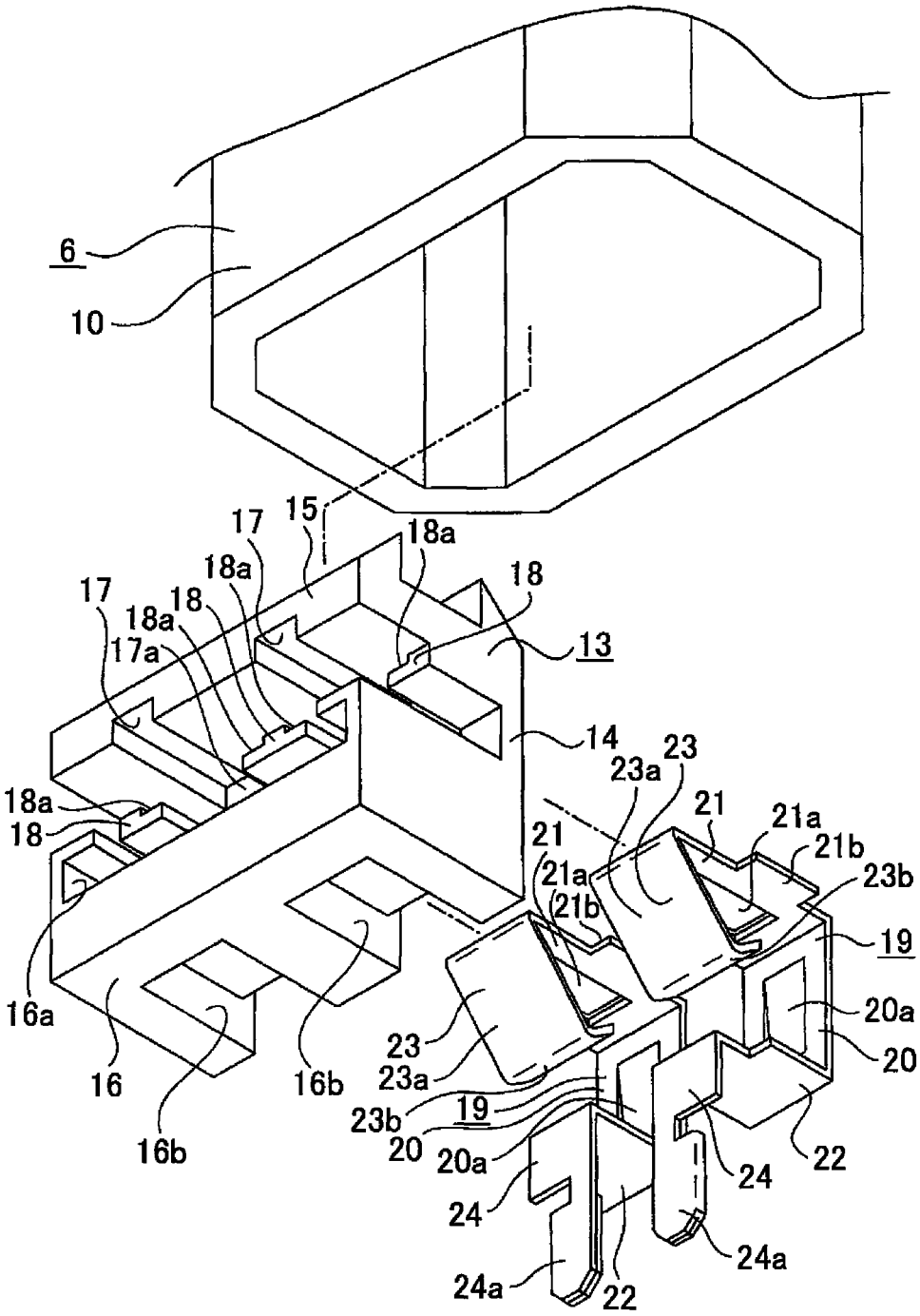
FIG. 4 is an enlarged exploded perspective view of the socket, the contact holder, and the contact member according to the embodiment.

The socket 6 is formed in a generally angular tube-shape that is L-shaped, and is connected to the lamp chamber 5 (see FIGS. 1 to 3). The socket 6 is formed of a generally angular tube-shaped first cylindrical portion 10 that extends vertically and is open downward, and a second cylindrical portion 11 that protrudes forward from a front surface of an upper half portion of the first cylindrical portion 10 and is open forward. A front end of the second cylindrical portion 11 is connected to the lamp body 2.

A horizontally long circuit board insertion hole 10*a* is formed in a front surface portion of the first cylindrical portion 10. This circuit board insertion hole 10*a* communicates with the second cylindrical portion 11 (see FIG. 2). An engaging protruding portion 12 that protrudes forward and extends left and right is provided on an inner surface of a rear surface portion of the first cylindrical portion 10. An engaging surface 12*a* that faces upward and an inclined surface 12*b* inclined such that the higher the vertical position is, the more the inclined surface 12*b* jut out forward, are formed vertically separated from one another on the engaging protruding portion 12.

A contact holder 13 is arranged on the upper half portion of the first cylindrical portion 10 of the socket 6. The contact holder 13 is made of nonconductive material such as resin, and includes a base surface portion 14 that faces in the front-rear direction, a first retaining portion 15 that protrudes forward from an upper end portion of the base surface portion 14, and a second retaining portion 16 that protrudes forward from a lower end portion of the base surface portion 14.

Insertion holes 14*a* are formed spaced apart from each other to the left and right in the base surface portion 14.

Insertion grooves 17 that are open forward and downward are formed spaced apart from each other to the left and right in the first retaining portion 15. Rear surfaces that form the insertion grooves 17 are formed as retaining portions 17*a*. Retaining protruding portions 18 that protrude downward are provided spaced apart from each other to the left and right on a lower surface side of the first retaining portion 15. A retaining groove 18*a* that opens inward and to the front and rear is formed in each of the retaining protruding portions 18 that are positioned on both the left and right sides. A retaining groove 18*a* that opens to the right or left and to the front and rear is formed in each of the retaining protruding portions 18 positioned in the center.

A circuit board insertion groove 16*a* that opens forward is formed in the second retaining portion 16. The circuit board insertion groove 16*a* is open upward except for at both left and right end portions. Arranging recessed portions 16*b* that open to the rear and downward are formed spaced apart from each other to the left and right on the lower surface side of the second retaining portion 16.

Contact members 19 are joined to the contact holder 13. The contact members 19 are formed of flat conductive material such as metal that has been processed into a predetermined shape.

The contact members 19 each include a middle surface portion 20 that faces in the front and rear directions, an engaging surface portion 21 that protrudes forward from an upper end portion of the middle surface portion 20, a connecting surface portion 22 that protrudes forward from a lower end portion of the middle surface portion 20, a connecting terminal portion 23 that is connected to a front end portion of the engaging surface portion 21, and a plug connecting portion 24 that protrudes downward from a front end portion of the connecting surface portion 22. The longitudinal direction of the plug connecting portion 24 of this invention means the extending direction in which the plug connecting portion 24 extends from the base end portion, and is the direction in which a power supply plug 25 is attached and detached to and from the plug connecting portion 24 in this direction.

Part of each middle surface portion 20 is cut and bent up to provide a first elastic engagement portion 20*a* that prevents relative movement of the corresponding contact member 19 with respect to the lamp body 2. The first elastic engagement portion 20*a* is inclined such that the lower the vertical position is, the more the first elastic engagement portion 20*a* juts out rearward.

Also, part of each engaging surface portion 21 is cut and bent up to provide a second elastic engagement portion 21*a* that prevents relative movement of the corresponding contact member 19 with respect to the contact holder 13. The second elastic engagement portion 21*a* is inclined such that the more rearward the position in the front-rear direction is, the more the second elastic engagement portion 21*a* juts out upward. Retainable pieces 21 that protrude to the left and right are provided on the engaging surface portions 21.

Each of the connecting terminal portions 23 includes a folded-back portion 23*a* that is bent downward with respect to the engaging surface portion 21, and is inclined such that the more rearward the position in the front-rear direction is, the more the folded-back portion 23*a* juts out downward, and a tip end portion 23*b* that is connected to a rear end of the folded-back portion 23*a*, and is inclined such that the more rearward the position in the front-rear direction is, the more the tip end portion 23*b* returns upward.

A generally lower half portion of the plug connecting portion 24 is provided as an overlapped portion 24*a* that is folded back so as to be doubled.

The contact members 19 are joined to the contact holder 13 by being inserted from the rear side-by-side. The contact members 19 are joined to the contact holder 13 by the second elastic engagement portions 21*a* and retainable pieces 21*b* of the engaging surface portion 21 being inserted into the insertion grooves 17 and the retaining grooves 18*a*, respectively, and the connecting surface portions 22 being inserted into the recessed portions 16*b*.

When the contact members 19 are being joined to the contact holder 13, the second elastic engagement portions 21*a* slidingly contact the front end portions of the lower surface of the first retaining portions 15 and elastically deform. Once past the front end portions, the second elastic engagement portions 21*a* then elastically return to their original shapes and become inserted in the insertion grooves 17.

When the contact members 19 have been joined to the contact holder 13, the second elastic engagement portions

21*a* are engaged with (i.e., retained by) the retaining portions 17*a* of the insertion grooves 17, the retainable pieces 21*b* are engaged with the retaining grooves 18*a*, and the connecting surface portions 22 are engaged with the recessed portions 16*b*. At this time, the overlapped portions 24*a* of the plug connecting portions 24 are positioned lower than the lower surface of the contact holder 13.

As described above, the contact members 19 are prevented from falling out of the contact holder 13 by the second elastic engagement portion 21*a* being engaged with (i.e., retained by) the retaining portions 17*a* of the insertion grooves 17.

The contact members 19 that are joined to the contact holder 13 are inserted from below into the socket 6 together with the contact holder 13. When the contact members 19 are being inserted into the socket 6 together with the contact holder 13, the first elastic engagement portions 20*a* slidingly contact the inclined surface 12*b* of the engaging protruding portion 12 and elastically deform. Once past the engaging protruding portion 12, the first elastic engagement portions 20*a* then elastically return to their original shapes and become engaged with the engaging surface 12*a*.

As described above, the contact members 19 and the contact holder 13 are prevented from falling out of the socket 6 by the first elastic engagement portions 20*a* being engaged with the engaging surface 12*a* of the engaging protruding portion 12. As a result, the contact members 19 and the contact holder 13 are retained inside the socket 6. Accordingly, in this embodiment, the engaging protruding portion 12 and the first elastic engagement portions 20*a* serve as an engaging portion of the invention.

When the contact holder 13 is retained inside the socket 6, the front surface of both the first retaining portion 15 and the second retaining portion 16 is pressed against the front surface portion of the socket 6.

As described above, when the contact members 19 and the contact holder 13 are retained inside the socket 6, one end portion (a rear end portion) of the circuit board 7 is inserted from the front into the circuit board insertion hole 10*a*, and inserted between the connecting terminal portions 23 of the contact members 19 and the second retaining portion 16 of the contact holder 13. The connecting terminal portions 23 are pressed due to elasticity against the electrode portions 7*d* of the circuit board 7, and the heat radiating portion 7*c* of the circuit board 7 is pressed against the second retaining portion 16.

Therefore, the circuit board 7 is pressed by the restoring force of the elastically deformed, connecting terminal portions 23 so as to be held by the contact members 19.

The power supply plug 25 that is connected to the power supply circuit is inserted into the socket 6, and the power supply plug 25 is connected to the plug connecting portions 24 of the contact members 19. Therefore, the drive current is supplied to the light source 8 from the power supply circuit via the power supply plug 25, the contact members 19, and the circuit board 7.

As described above, the contact members 19 are joined to the contact holder 13 and arranged inside the socket 6, so that by designing the shape and size of the contact holder 13 according to the shape and size of the contact members 19, the contact members 19 will become able to be retained in the socket 6 regardless of their shape and size.

Accordingly, the degree of freedom in the design of the contact members 19 is improved by using the contact holder 13.

In addition, the retaining portions 17*a* are formed on the contact holder 13, and the contact members 19 are joined to the contact holder 13 by the second elastic engagement portions 21*a* being engaged with the retaining portions 17*a*.

Therefore, the contact members 19 are easily and reliably joined to the contact holder 13, and a stable joined state of the contact members 19 with respect to the contact holder 13 is ensured.

Furthermore, the engaging protruding portion 12 that has the engaging surface 12*a* is provided on the socket 6, and the contact members 19 and the contact holder 13 are retained inside the socket 6 by the first elastic engagement portions 20*a* being engaged with this engaging surface 12*a*, so that the contact members 19 and the contact holder 13 are easily and reliably held in the socket 6.

Figure 5:
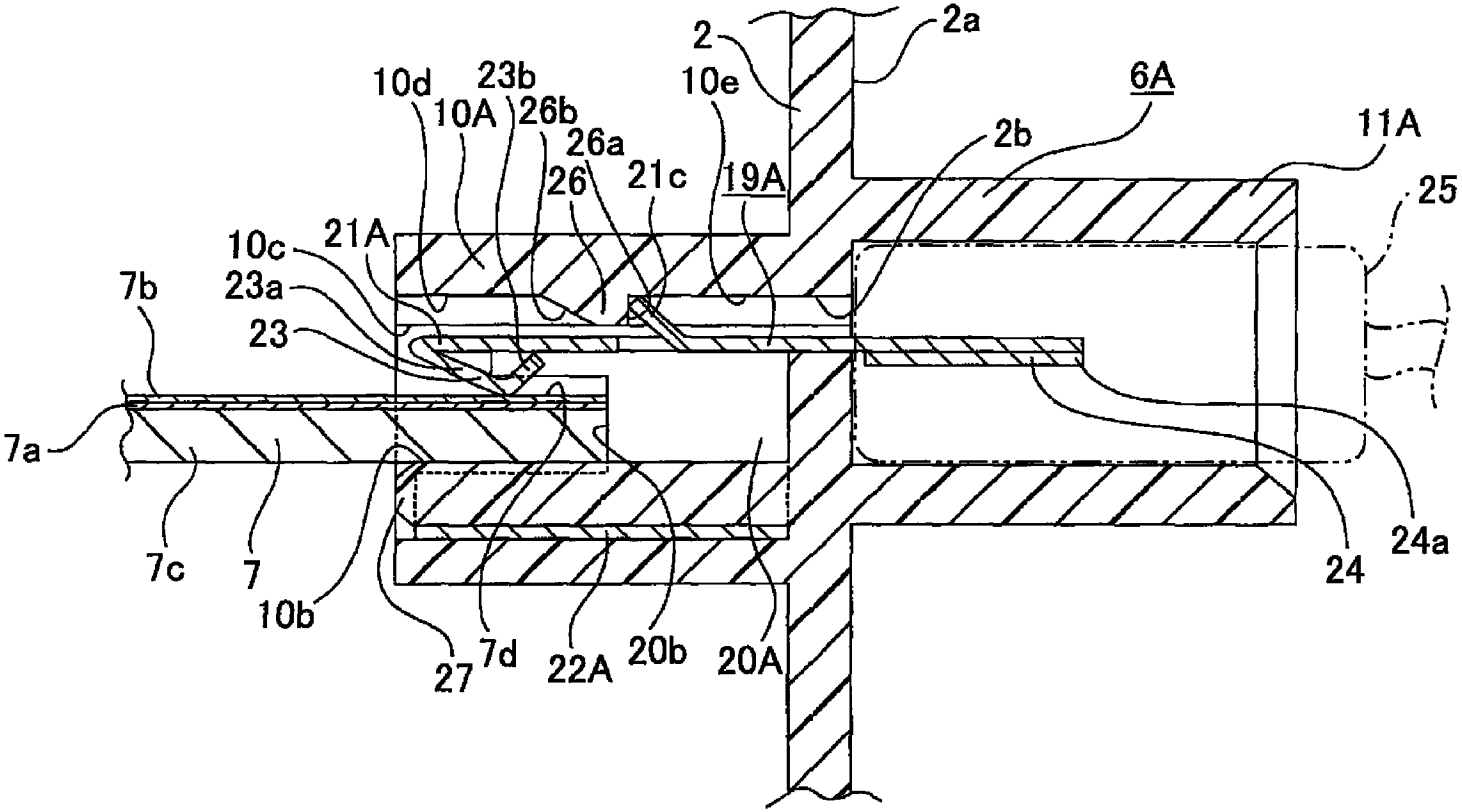
FIG. 5 is an enlarged sectional view of a modification of the socket and the contact members according to the embodiment, in a state in which contact members are inserted in a socket.
Figure 6:
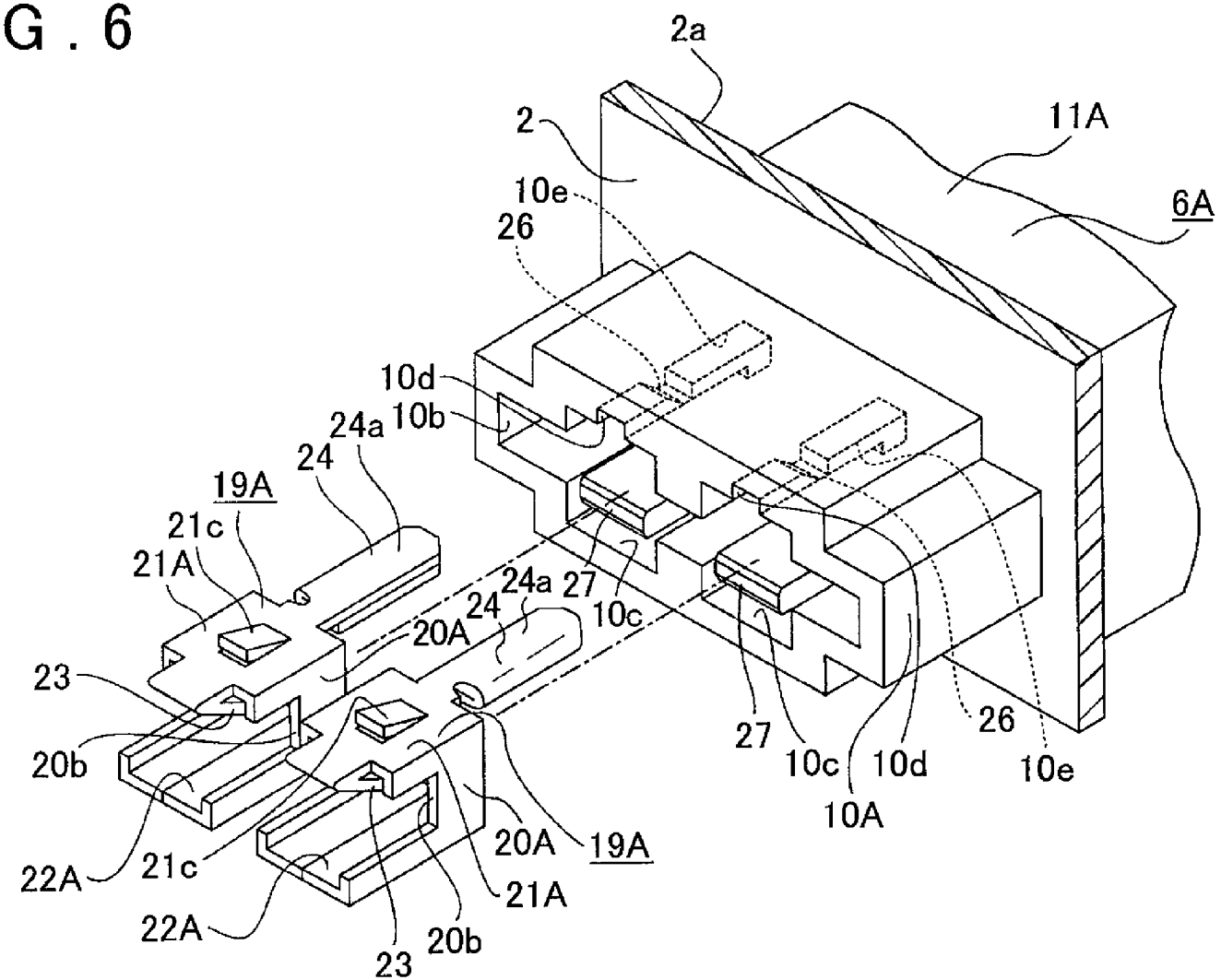
FIG. 6 is an enlarged exploded perspective view of the socket and the contact members shown in FIG. 5.

Next, a modification of the socket and the contact members will be described (see FIGS. 5 and 6). A socket 6A according to the modification is connected to the rear surface portion 2*a* of the lamp body 2. The socket 6A may be formed by a member separate from the lamp body 2, or it may be formed integrally with the lamp body 2. Forming the socket 6A integrally with the lamp body 2 reduces the manufacturing cost owing to the decrease in the number of parts.

Insertion holes 2*b* are formed spaced apart from each other to the left and right in a rear surface portion of the lamp body 2 to which the socket 6A is connected.

The socket 6A is formed by a generally angular tube-shaped first cylindrical portion 10A that protrudes forward from the rear surface portion 2*a*, and a generally angular tube-shaped second cylindrical portion 11A that protrudes rearward from the rear surface portion 2*a*. The first cylindrical portion 10A and the second cylindrical portion 11A communicate with each other by the insertion holes 2*b* of the lamp body 2.

A horizontally long circuit board insertion hole 10*b* that is open to the front is formed in the first cylindrical portion 10A. Member arranging holes 10*c* that are open to the front are formed spaced apart from each other to the left and right in the first cylindrical portion 10A. The member arranging holes 10*c* are positioned intersecting the circuit board insertion hole 10*b* and part of these member arranging holes 10*c* are common with the circuit board insertion hole 10*b*.

Front insertion grooves 10*d* that open downward and forward and extend in the front-rear direction are formed spaced apart from each other to the right and left in an upper surface portion of the first cylindrical portion 10A. Rear insertion grooves 10*e* that are to the rear of the front insertion grooves 10*d* and separated from the front insertion grooves 10*d*, and that open downward and extend in the front-rear direction, are formed in the upper surface portion of the first cylindrical portion 10A. The front insertion grooves 10*d* and the rear insertion grooves 10*e* communicate with the member arranging holes 10*c*.

Engaging protrusions 26 are provided between the front insertion grooves 10*d* and the rear insertion grooves 10*e*, on the upper surface portion of the first cylindrical portion 10A. Each of the engaging protrusions 26 includes an engaging surface 26*a* that faces rearward, and an inclined surface 26*b* that is positioned forward of the engaging surface 26*a* and is inclined such that the more rearward the position in the front-rear direction is, the more the inclined surface 26*b* juts out downward.

Retaining protruding portions 27 that protrude forward are provided spaced apart from each other to the left and right on the first cylindrical portion 10A. These retaining protruding portions 27 are provided in positions toward the lower end side of the member arranging holes 10*c*. The lateral width of the retaining protruding portions 27 is smaller than the width in the left-right direction of the member arranging holes 10*e*.

Contact members 19A according to this modification are formed by flat conductive material such as metal that has been processed into a predetermined shape.

Each of the contact members 19A includes side surface portions 20A that face in the left-right direction and are positioned spaced apart from each other to the left and right, an engaging surface portion 21A provided so as to connect upper end portions of the side surface portions 20A together, a connecting surface portion 22A provided so as to connect lower end portions of the side surface portions 20A together, a connecting terminal portion 23 that is connected to a front end portion of the engaging surface portion 21A, and a plug connecting portion 24 that protrudes to the rear from an upper end portion of the engaging surface portion 21A.

Insertion cutouts 20*b* that open to the front are formed in the side surface portions 20A.

Part of the engaging surface portion 21A is cut and bent up to provide an first elastic engagement portion 21*c*. The first elastic engagement portion 21*c* is inclined such that the more forward the position in the front-rear direction is, the more the first elastic engagement portion 21*c* juts out upward.

The contact members 19A are inserted side-by-side from the front into the member arranging holes 10*c* of the socket 6A. When inserting the contact members 19A into the socket 6A, the first elastic engagement portions 21*c* are inserted into the front insertion grooves 10*d*, and the retaining protruding portions 27 are inserted between the side surface portions 20A.

When the first elastic engagement portions 21*c* are being inserted into the front insertion grooves 10*d*, the first elastic engagement portions 21*c* slidingly contact the inclined surfaces 26*b* of the engaging protrusions 26 and elastically deform. Once past the engaging protrusions 26, the first elastic engagement portions 21*c* then elastically return to their original shapes, and are inserted into the rear insertion grooves 10*e* and become engaged with the engaging surface 26*a*.

As described above, the contact members 19A are prevented from falling out of the socket 6A by the first elastic engagement portions 21*c* being engaged with the engaging surfaces 26*a* of the engaging protrusions 26. As a result, the contact members 19A are retained inside the socket 6A. Accordingly, in this modification, the engaging protrusions 26 and the first elastic engagement portions 21*c* serve as an engaging portion of the invention.

When the contact members 19A are retained inside the socket 6A, the connecting surface portions 22A are inserted below the retaining protruding portions 27, and the plug connecting portions 24 are inserted into the insertion holes 2*b* and positioned inside the second cylindrical portion 11A.

When the contact members 19A are retained inside the socket 6A, one end portion (a rear end portion) of the circuit board 7 is inserted from the front into the circuit board insertion hole 10*b*, and inserted between the connecting terminal portions 23 of the contact members 19A and the retaining protruding portions 27 of the socket 6A. The rear end portion of the circuit board 7 is inserted into the insertion cutouts 20*b* of the contact members 19A, and the rear end surface is made to contact the side surface portions 20A. The connecting terminal portions 23 are pressed against the electrode portions 7*d* due to elasticity, and the heat radiating portion 7*c* is pressed against the retaining protruding portions 27.

Therefore, the circuit board 7 is pressed by the restoring force of the elastically deformed, connecting terminal portions 23 so as to be held by the contact members 19A.

The power supply plug 25 is inserted into the second cylindrical portion 11A of the socket 6A, and the power supply plug 25 is connected to the plug connecting portions 24 of the contact members 19A. Therefore, the drive current is supplied to the light source 8 from the power supply circuit via the power supply plug 25, the contact members 19A, and the circuit board 7.

As described above, the contact members 19A are retained in the socket 6A without using a contact holder, so that the manufacturing cost of the vehicular lamp 1 is reduced, by the amount of the contact holder, owing to the decrease in the number of parts.

Furthermore, the engaging protrusions 26 that have the engaging surfaces 26*a* are provided on the socket 6A, and the contact members 19A are retained inside the socket 6A by the first elastic engagement portions 21*c* being engaged with these engaging surfaces 26*a*, so that the contact members 19A are easily and reliably held in the socket 6A.

As described above, in this vehicular lamp 1, the circuit board 7 is held by the contact members 19 or the contact members 19A due to the elasticity of the connecting terminal portions 23 provided on the contact members 19 or the contact members 19A.

Therefore, a harness for supplying drive current to the light source 8 is not necessary, so that neither the work of connecting a harness to the circuit board by soldering nor the work of pulling the harness around inside and outside of the lamp body is needed. Hence, workability related to the assembly of the circuit board 7 and the like is improved.

Also, it is possible to connect the circuit board 7 and the contact members 19 and 19A by only the work of inserting the circuit board 7 into the socket 6 and 6A, so that the manufacturing cost of the vehicular lamp 1 is reduced due to the improvement of workability related to the connecting work.

Furthermore, the heat radiating portion 7*c* of the circuit board 7 is pressed against a nonconductive portion, i.e., the second retaining portion 16 of the contact holder 13 or the retaining protruding portions 27 of the socket 6A, due to the elasticity of the connecting terminal portions 23, so that a short in the circuit board 7 is inhibited.

The heat radiating portion 7*c* may also be provided on at least a portion of the circuit board 7, the portion including an end portion on the side that is inserted into the socket 6 and 6A.

The shapes and structures of the portions illustrated in the embodiments described above represent only specific examples used in the implementation of the invention. The technical scope of the invention shall not be construed as being limited to these embodiments.

The vehicular lamp may further include a contact holder that is made of nonconductive material and is retained in the socket, wherein the contact member is joined to the contact holder and arranged inside the socket.

With the above configuration, by designing the shape and size of the contact holder according to the shape and size of the contact member, the contact member will become able to be retained in the socket regardless of its shape and size, so that the degree of freedom in the design of the contact member is improved.

A retaining portion may be formed on the contact holder, an elastically deformable second elastic engagement portion may be provided on the contact member, and the second elastic engagement portion may be engaged with the retaining portion to join the contact member to the contact holder. The retaining portion may be provided on the contact holder, and may have a surface that faces in a direction of movement, during assembly, of the contact member relative to the contact holder, and the second elastic engagement portion may be provided on the contact member, may be inclined such that an amount of jutting-out of the second elastic engagement portion from the contact member increases in a direction opposite the direction of the movement, during assembly, of the contact member relative to the contact holder, and may be formed by cutting and bending up a portion of the contact member.

With the above configuration, the contact member is simply and reliably joined to the contact holder, and a stable joined state of the contact member with respect to the contact holder is ensured.

The vehicular lamp may further include: an isolation portion that is provided on at least the one end portion of the circuit board, and on one surface of which the electrode portion is formed; and a heat radiating portion that is provided on at least the one end portion of the circuit board, that contacts the other surface of the isolation portion, and that is made of metallic material, wherein the heat radiating portion is pressed against a nonconductive portion by the restoring force of the connecting terminal portion elastically deformed.

With the above configuration, it is possible to inhibit a short in the circuit board.

The socket may be integrally formed with the lamp body.

With the above configuration, the manufacturing cost is reduced owing to the decrease in the number of parts.

What is claimed is:

1. A vehicular lamp comprising:

a light source that emits light;

a lamp body, inside of which the light source is arranged;

a circuit board that has a conductive pattern that functions as an electrically-conducting path of drive current to be supplied to the light source, and on one end portion of which an electrode portion connected to the conductive pattern is formed;

a socket connected to the lamp body; and a contact member that is arranged in the socket and has an elastically deformable connecting terminal portion connected to the electrode portion of the circuit board, and a plug connecting portion, to which a power supply plug is connected, wherein the circuit board is pressed by restoring force of the connecting terminal portion, elastically deformed, so as to be held by the contact member;

further comprising an engaging portion that prevents relative movement of the contact member with respect to the lamp body in a longitudinal direction of the plug connecting portion.

2. The vehicular lamp according to claim 1, wherein the engaging portion is configured not to prevent the relative movement of the contact member to a fixation position, at which the contact member is fixed, during assembly of the contact member and configured to prevent the relative movement of the contact member from the fixation position.

3. The vehicular lamp according to claim 2, wherein the engaging portion includes:

an engaging protrusion that is provided on the lamp body, and has an engaging surface that faces in a direction of the relative movement, during assembly, of the contact member with respect to the lamp body; and a first elastic engagement portion that is provided on the contact member, that is inclined such that an amount of jutting-out of the first elastic engagement portion from the contact member increases in a direction opposite the direction of the relative movement, during assembly, of the contact member with respect to the lamp body, and that is formed by cutting and bending up a portion of the contact member.

4. The vehicular lamp according to claim 3, wherein the engaging protrusion has an inclined surface that is inclined such that an amount of jutting-out of the engaging protrusion from the lamp body increases in the direction of the relative movement, during assembly, of the contact member with respect to the lamp body.

5. The vehicular lamp according to claim 1, further comprising a contact holder that is made of nonconductive material and is retained in the socket, wherein the contact member is joined to the contact holder and arranged inside the socket.

6. The vehicular lamp according to claim 5, wherein a retaining portion is formed on the contact holder;

an elastically deformable second elastic engagement portion is provided on the contact member; and the second elastic engagement portion is engaged with the retaining portion to join the contact member to the contact holder.

7. The vehicular lamp according to claim 6, wherein the retaining portion is provided on the contact holder, and has a surface that faces in a direction of movement, during assembly, of the contact member relative to the contact holder, and the second elastic engagement portion is provided on the contact member, is inclined such that an amount of jutting-out of the second elastic engagement portion from the contact member increases in a direction opposite the direction of the movement, during assembly, of the contact member relative to the contact holder, and is formed by cutting and bending up a portion of the contact member.

8. The vehicular lamp according to claim 1, further comprising:

an isolation portion that is provided on at least the one end portion of the circuit board, and on one surface of which the electrode portion is formed; and a heat radiating portion that is provided on at least the one end portion of the circuit board, that contacts the other surface of the isolation portion, and that is made of metallic material, wherein the heat radiating portion is pressed against a nonconductive portion by the restoring force of the connecting terminal portion elastically deformed.

9. The vehicular lamp according to claim 1, wherein the socket is integrally formed with the lamp body.

* * * * *